US005169041A

United States Patent [19]

Tan

[11] Patent Number: 5,169,041

[45] Date of Patent: Dec. 8, 1992

[54] PORTABLE SEWING KIT

[75] Inventor: Danilo G. Tan, Binondo, Philippines

[73] Assignee: Deje E-Z Enterprises, Inc., San Francisco, Calif.

[21] Appl. No.: 781,005

[22] Filed: Oct. 18, 1991

[51] Int. Cl.[5] ..... A41H 31/00

[52] U.S. Cl. ..... 223/109 R; 206/574; 206/227

[58] Field of Search ..... 223/106, 108, 109 R; 206/574, 227, 228, 380, 382, 383

[56] References Cited

U.S. PATENT DOCUMENTS

| | | | |
|---|---|---|---|
| 1,733,825 | 10/1929 | Rosenthal | 206/574 |
| 2,287,790 | 6/1942 | Butland | 223/108 |
| 2,586,505 | 2/1952 | Beverino | 223/106 X |
| 4,782,954 | 11/1988 | Reynolds | 223/109 R X |
| 4,823,948 | 4/1989 | Bonar | 206/227 |

*Primary Examiner*—Werner H. Schroeder
*Assistant Examiner*—Sara M. Current
*Attorney, Agent, or Firm*—Majestic, Parsons, Siebert & Hsue

[57] ABSTRACT

The portable sewing kit includes an elongated housing for holding a needle with a point at one end and an eyelet at the other end. A spool section is integrally connected to the housing and extends away from the housing. The spool section has a width which is smallest at the end connected to the housing and increases to reach a maximum at the end furthest from the housing. A button is integrally connected to the spool section and is coplanar with both the spool section and the housing. The button has a diameter which is substantially equal to the maximum width of the spool section.

5 Claims, 1 Drawing Sheet

PORTABLE SEWING KIT

BACKGROUND OF THE INVENTION

This invention relates to a novel sewing kit. More specifically, this invention relates to a sewing kit which includes a prethreaded needle and permits a user to facilely mend fabric or resew a button.

When a cloth tears or a button falls off a piece of clothing, it is usually desirable to mend the tear or resew the button. When the repair needs to be done and the user is away from home, sewing supplies may not be readily accessible. Thus, hotels often provide portable sewing kits which contain the necessary mending elements, including a needle and thread. These kits may also be purchased so that a user may have one readily available when a repair is needed.

Portable sewing kits are compact and convenient. One type of portable sewing kit includes a piece of cardboard having different color threads wrapped around it. The card, a needle, and a button are placed in a package. While this type of kit provides all of the necessary sewing elements, the user is still confronted with the task of threading the needle. This is a difficult task for some people, and so sewing kits which include prethreaded needles have been produced. However, in kits with a single needle and different color threads packaged on a piece of cardboard, obviously only one color thread may be threaded through the needle. The desired color will not always be available threaded, and so the different color cardboard arrangement does not adequately provide an array of colors prethreaded onto a needle.

Sewing kits having needles prethreaded with a single color thread have been packaged on elongated cards. Since the different color threads are individually packaged, a user can choose the desired color threaded through a needle. A button is usually provided separately from this type of package. Removal of the threaded needle in this type of portable sewing kit may be awkward, however, because of the shape of the elongated card. To remove the thread, the card and thread must be rotated, which may be an uncomfortable motion for some users. The thread may also snag on the housing during unwinding. This type of sewing kit therefore does not satisfactorily facilitate mending, especially when a user is in a rush. In addition, prior sewing kits of this type have sometimes not adequately contained the needle within the sewing package, resulting in the presence of a safety hazard to the user.

The difficulties suggested in the preceding are not intended to be exhaustive but rather are among some which may tend to reduce the effectiveness and usefulness of prior portable sewing kits. Other noteworthy problems may also exist; however, those presented above should be sufficient to demonstrate that portable sewing kits appearing in the past will admit to improvement.

It is therefore an object of the invention to provide a portable sewing kit which obviates the problems of the type described above.

It is a specific object of the invention to provide a portable sewing kit which may be facilely used and which provides all of the elements necessary to mend a fabric or to sew a button to a fabric.

It is another object of the invention to provide a portable sewing kit which is easily fabricated, inexpensive, safe, and reusable.

SUMMARY OF THE INVENTION

One aspect of the invention which accomplishes at least some of the foregoing objects includes a portable sewing kit having a needle with a point at one end and an eyelet at the other end. An elongated housing is provided and includes means for securing the needle to the housing. A spool section is integrally connected to the housing and extends away from the housing. The spool section has a width which is smallest at the end connected to the housing, and increases to reach a maximum at the end furthest from the housing. A button is integrally connected to the spool section and is coplanar with both the spool section and the housing. The button has a diameter which is substantially equal to the maximum width of the spool section, and thereby facilitates axial unwinding of the thread from the spool section.

DESCRIPTION OF THE DRAWINGS

Other advantages of the present invention will become apparent from the following detailed description of a preferred embodiment thereof, taken in conjunction with the accompanying drawings, wherein.

DETAILED DESCRIPTION OF THE INVENTION

Figure 1:
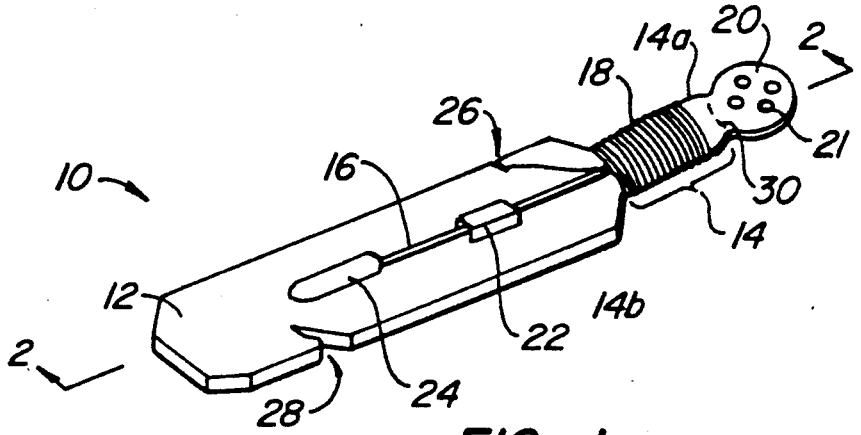
FIG. 1 is an axonometric view of the subject sewing kit.

Referring now to the drawings, wherein like numerals indicate like parts, and initially to FIG. 1, there will be seen a sewing kit in accordance with a preferred embodiment of the present invention. More specifically, a sewing kit 10 includes an elongated housing 12 which holds a removable threaded needle 16. The housing 12 is connected to a spool section 14, and the thread 18 is wrapped around the spool section 14 to hold the needle in place. A button 20 is connected to the spool section 14, as shown. The spool section 14 tapers or decreases in width from the button end **14*a* to the housing end 146; the tapered design prevents the thread from slipping off the edge of the spool section. In the preferred embodiment, housing 12, section 14 and button 20 are made as a single-integral unit. The button 20 has buttonholes 21, and has a width which is preferably equal to the maximum width of the spool section in order to facilitate unwinding of the thread from the spool. The design of the sewing kit 10** will be described in more detail below.

The needle 16 is removably fastened to the housing 12 by a first holder 22 and a second holder 24. Thread 18 is wrapped around the spool section 14 and also holds the needle in place. The needle 16 is preferably threaded for facile use, but thread may also be wrapped around an unthreaded needle. An unthreaded needle is obviously not as desirable as a threaded needle because it is not as easily used. The thread 18 is fastened to the housing 16 at slit 26 to prevent the thread from unwinding. A cutting edge 28 is provided so that a user may snip the thread as needed. The button 20 is integrally connected to the spool section 14 along line 30, and can easily be pulled apart from the spool section.

The sewing kit is portable and is approximately 6.5 cm wide and 1.5 cm long in the preferred embodiment, but may of course be any suitable size. The sewing kit is reusable because the needle may be rethreaded with different thread and secured to the housing. This feature is especially useful when the button is not needed; the sewing kit is then fully functional after the needle has been rethreaded. The housing is composed of a lightweight plastic, which makes the kit durable and inexpensive.

Figure 2:
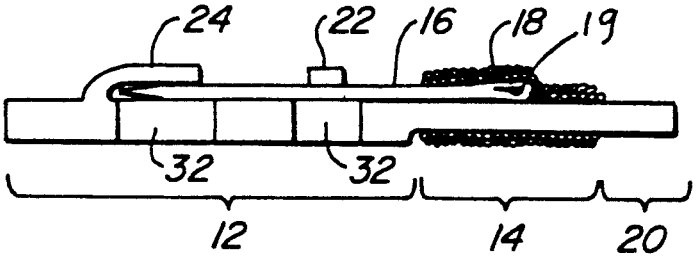
FIG. 2 is a cross-sectional view taken along line 2—2 in FIG. 1.

Referring now to FIG. 2, shown is a cross-sectional view of the sewing kit 10 as taken along line 2—2 in FIG. 1. As can be seen, the housing 12, the spool section 14, and the button 20 are coplanar. After threading the needle with thread 18, the needle is positioned on the sewing kit by axially inserting the pointed end of the needle into the housing 12 between the first holder 22 and the housing 12. The needle is inserted further until it almost contacts the second holder 24, which is designed to prevent the needle point from contacting a user. The second holder 24 is pocket-shaped and prevents the user from being dangerously exposed to the needle.

The housing has openings 32 which permit a user to visually guide the needle in place by viewing the needle movement from the bottom side of the sewing kit. The openings 32 also facilitate manufacture of a sewing kit die mold. After the needle is properly positioned, thread 18 is wrapped around the spool section 14 to secure the needle. The unwrapped thread is fastened through slit 26.

Figure 3:
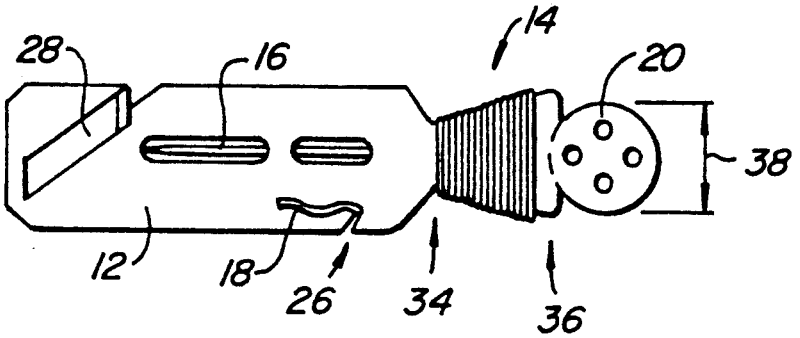
FIG. 3 is a bottom plan view of the subject sewing kit and better illustrates the novel shape of the spool section.

FIG. 3 is a bottom plan view of the sewing kit 10, and better illustrates the shape of the novel spool section 14. The spool section 14 increases in width from the point 34 closest to the housing 12 to the maximum width at point 36. The changing width of the spool section 14 prevents the thread from slipping off the spool section because it will slide toward the narrower portion of the spool section if it becomes loose. For instance, if the spool section had a constant width along its length, the thread would more likely slip off the spool section. Since the sewing kit is relatively small and portable, it will most likely be carried in pockets, purses, or the like, on which the thread may snag. The tapered spool section thus increases the safety of the sewing kit by insuring that the needle remains protected in the housing 12.

The diameter of the button 20 is shown as length 38, and in the preferred embodiment of the invention is approximately equal to the maximum width of the spool section 14. This arrangement facilitates unwinding of the thread from the spool section. Since the button diameter is less than the width of the spool section, the thread can be simply pulled from the spool section in an axial direction. When the thread is being pulled from the narrowest portion of the spool section, a user may have to slightly rotate the sewing kit in order to remove the thread. If the button diameter were greater than the spool section, a user would have to rotate the sewing kit or the thread considerably in order to remove the thread. Since the button diameter is approximately equal to the width of the spool section at point 36, there is a small gap between the two. It is therefore unlikely that the thread will catch on the button when it is being unwound.

Also shown in FIG. 3 is the cutting edge 28, which is integrally connected to the bottom surface of the housing 12. The cutting edge permits a user to quickly and easily snip thread. The cutting edge 28 is glued to the surface of the housing 12 so that it is flush with the bottom surface of the housing.

After reading and understanding the foregoing inventive sewing kit, in conjunction with the drawings, it will be appreciated that several distinct advantages of the subject invention are obtained. Without attempting to set forth all of the desirable features of the instant invention, at least some of the major advantages of the invention include the tapered spool section 14. The shape of the spool section ensures that the thread wrapped around it will not slip off the end, thereby preventing the needle from exiting the housing. The tapered edge thus enhances the safety of the sewing kit 10.

Another advantage of the invention is the integrally-fashioned button having a diameter substantially equal to the maximum width of the spool section 14. This feature permits the thread wrapped around the spool section to be facilely removed from the sewing kit in an axial direction. Since there is a small gap between the button and the spool section, there is little room for the thread to snag on the button. The button diameter is not greater than the spool section, and therefore a user barely, if at all, has to rotate the thread or the sewing kit to remove the thread. The thread may be simply pulled from the housing in an axial direction without inconveniently catching on the button.

It should be noted that although the invention has been described with reference to specific embodiments, it should not be construed to be so limited. Those skilled in the art and familiar with the instant disclosure of the subject invention may recognize additions, deletions, modifications, substitutions and other changes which will fall within the purview of the subject invention and claims.

What is claimed is:

1. A sewing kit comprising:

a needle having first and second ends, said first end forming a point and said second end having an eyelet fashioned therethrough;

an elongated housing having a first end and a second end, the housing further including means for securing the needle to the housing, the needle extending along the length of the housing such that the needle point is adjacent to the first end of said housing;

a spool section forming an integral unit with the second end of said housing, said spool section having a minimum width at the connection to the housing, the width increasing to reach a maximum at a point away from the housing; and a button forming an integral unit with a spool section, said button being coplanar with said housing and said spool section, said button having a diameter which is substantially equal to the maximum width of said spool section.

2. A sewing kit as claimed in claim 1 wherein said housing has two sides and wherein said securing means further comprises:

a first holder fashioned on one side of said housing, the first holder being pocket-shaped to enclose the first end of the needle a second holder fashioned on the same side of said housing as said first holder, the second holder being tunnel-shaped and providing a guide for insertion of the needle to the first holder.

3. A sewing kit as claimed in claim 1 and further including cutting means adapted to cut the thread.

4. A sewing kit as claimed in claim 3 wherein said cutting means includes a razor integrally fashioned into said housing.

5. A sewing kit as claimed in claim 1 and further including a length of thread, said thread being threaded through the eyelet of said needle, said needle being positioned in the housing, said thread being wrapped around the spool section of said sewing kit to hold said needle in place.

* * * * *